US005515579A

United States Patent [19]

Hösel

[11] Patent Number: 5,515,579

[45] Date of Patent: May 14, 1996

[54] COILER HEAD STOPPAGE WHILE DEPOSITING SLIVER IN A COILER CAN

[75] Inventor: Fritz Hösel, Mönchengladbach, Germany

[73] Assignee: Trützschler GmbH & Co. KG, Mönchengladbach, Germany

[21] Appl. No.: 465,633

[22] Filed: Jun. 5, 1995

[30] Foreign Application Priority Data

Aug. 11, 1994 [DE] Germany ..... 44 28 477.2

[51] Int. Cl.[6] ..... B65H 54/80; D01G 27/00

[52] U.S. Cl. ..... 19/159 R

[58] Field of Search ..... 19/159 R, 159 A, 19/159.2, 159.21, 159.22, 106 R; 206/388; 57/281; 83/913

[56] References Cited

U.S. PATENT DOCUMENTS 3,268,953 8/1966 Burnham ..... 19/106 R
5,172,453 12/1992 Akiyama .

FOREIGN PATENT DOCUMENTS 2821325 11/1979 Germany ..... 19/159 R
3616833 11/1987 Germany ..... 19/159 A
1164917 9/1969 United Kingdom ..... 19/159 R
2019905 11/1979 United Kingdom .

*Primary Examiner*—Ismael Izaguirre
*Attorney, Agent, or Firm*—Spencer & Frank

[57] ABSTRACT

An apparatus for depositing sliver in a coiler can includes a pair of cooperating pressure rolls; a coiler head supported for rotation about a rotary axis and having a sliver outlet situated eccentrically with respect to the rotary axis; a movable coiler can support disposed underneath the coiler head for receiving an upwardly open coiler can thereon; and a drive for rotating the pressure rolls, for rotating the coiler head and for moving the coiler can support to advance the sliver through the pressure rolls into the coiler head and to deposit the sliver in an annular pattern into the coiler can. A control and regulating device is electrically connected to the drive and stops rotation of the coiler head at a predetermined location of the sliver outlet on its circular path while the pressure rolls continue to rotate and the coiler can support continues to move. A severing device is further provided for severing the sliver to produce an outer sliver end of the sliver deposited in the coiler can.

20 Claims, 6 Drawing Sheets

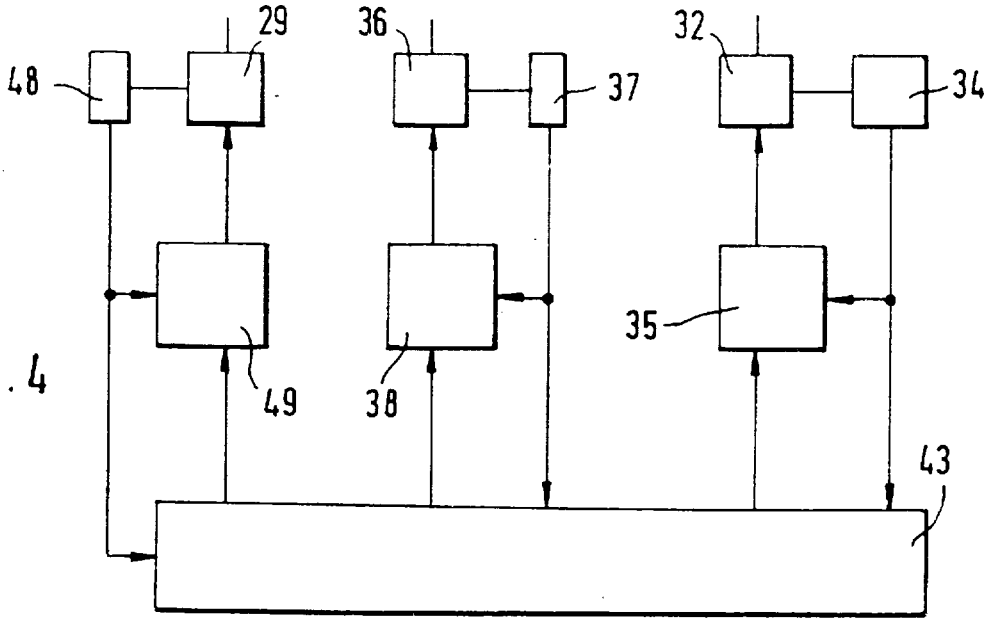
FIG. 4
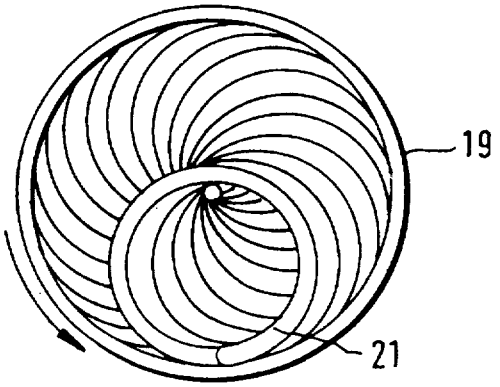
FIG. 5
FIG. 6
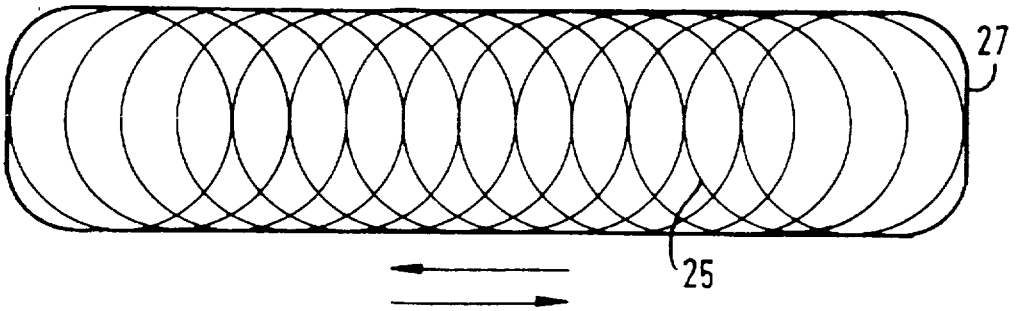

COILER HEAD STOPPAGE WHILE DEPOSITING SLIVER IN A COILER CAN

CROSS-REFERENCE TO RELATED APPLICATION

This application claims the priority of German Application No. P 44 28 477.2 filed Aug. 11, 1994, which is incorporated herein by reference.

BACKGROUND OF THE INVENTION

This invention relates to a method and an apparatus for depositing textile sliver in a coiler can from a sliver-producing machine, such as a carding machine or a drawing frame. The sliver is delivered by pressure rolls and is deposited in an annular pattern by a rotary coiler head into a coiler can moved underneath the coiler head. The coiler head is driven by a separate drive and the rotary motion of the coiler head is controlled and regulated.

According to a known method, mechanically mutually independent electric motors are provided for driving the sliver-advancing pressure rolls and for rotating the coiler head to effect an epicycloidal deposition of the sliver into the coiler can and furthermore, a separate drive is provided for the coiler can platform to rotate the coiler can during the sliver deposition. The electric motors are connected to one another in series. It is a disadvantage of this conventional method that the coiler head cannot be stopped by itself while the sliver advancing pressure rolls and the coiler can platform continue to rotate. Because of the electric connection of the electric motors to one another, a stoppage of the coiler head automatically effects the stoppage of the pressure rolls and the coiler can platform. Similarly, it is not possible to stop the coiler head in a certain position with the conventional method in order to deposit, for example, the sliver end at a predetermined location.

SUMMARY OF THE INVENTION

It is an object of the invention to provide an improved method and apparatus of the above-outlined type from which the discussed disadvantages are eliminated and which, in particular, makes possible the deposition of the sliver end at a predetermined location of the coiler can.

This object and others to become apparent as the specification progresses, are accomplished by the invention, according to which, briefly stated, the apparatus for depositing sliver in a coiler can includes a pair of cooperating pressure rolls; a coiler head supported for rotation about a rotary axis and having a sliver outlet situated eccentrically with respect to the rotary axis; a movable coiler can support disposed underneath the coiler head for receiving an upwardly open coiler can thereon; and a drive for rotating the pressure rolls, for rotating the coiler head and for moving the coiler can support to advance the sliver through the pressure rolls into the coiler head and to deposit the sliver in an annular pattern into the coiler can. A control and regulating device is electrically connected to the drive and stops rotation of the coiler head at a predetermined location of the sliver outlet on its circular path while the pressure rolls continue to rotate and the coiler can support continues to move. A severing device is further provided for severing the sliver to produce an outer sliver end of the sliver deposited in the coiler can.

By virtue of the fact that the rotary motion of the coiler head is stopped in a predetermined position of the coiler can, a deposition of the sliver end at a predetermined location of the coiler can is made possible in a simple manner. The continued delivery of the sliver by the pressure rolls and the simultaneous motion of the coiler can have the advantage that a linear terminal sliver length portion is obtained which hangs over the edge of the coiler can wall and constitutes the sliver end after severing. It is a further advantage of the method according to the invention that the deposition of a predetermined total sliver quantity is feasible.

In the apparatus according to the invention, the drive for the coiler head is electrically connected with a control and regulating device which includes an arrangement for stopping the rotary motion of the coiler head in a predetermined position while, at the same time, the pressure rolls continue to deliver the sliver and the coiler can continues to move.

The invention further has the following additional advantageous features:

- A separate drive is provided for the coiler head.
- A separate drive is provided for the can-moving platform.
- Each drive has its own rpm-regulating circuit and is formed of a motor, an rpm control device and an rpm transmitter.
- The desired values for the drives are calculated and pre-applied by a central control unit.
- The desired values determined by the control unit are in a predetermined, variable ratio to the output rate of the sliver-producing machine.
- The desired values determining the delivery speed of the sliver-producing machine are outputted by the same control unit that controls the coiler.
- The predetermined desired values are, during operation, in a fixed relationship to one another.
- At least one desired value (for example, for example, the rpm for the coiler head) has a zero value while the machine continues to produce sliver.
- The desired values for the drives during the production are adapted to technological or other parameters.
- The coiler head is provided with a sensor which is connected with the control device to allow the latter to determine the momentary position of the coiler head in its circular travel path. The sensor may be an absolute value transmitter or an incremental value transmitter.
- The sensor comprises at least one inductive proximity switch as well as appropriate buffer elements at the coiler head.
- The sensor comprises an optical scanning system.
- At least one actuating element and one sensor are provided which report to the control device when the sliver outlet of the coiler head has reached a predetermined position in its circular travel path.
- The actuating element is situated on the coiler head or on a coiler head driving element and its position is adjustable such that upon reaching any desired position along the circular travel path of the coiler head, the sensor may be activated.
- A device is provided which separates the drive for the coiler head from the other driving elements of the sliver coiler.
- The device for separating the coiler head drive from the other driving elements is a remote controlled clutch which is actuated by the central control device. The clutch is expediently an electromagnetic clutch.

BRIEF DESCRIPTION OF THE DRAWINGS

FIG. 4 is a block diagram of a preferred embodiment of the invention associated with a drawing frame handling flat coiler cans.

FIG. 5 is a top plan view of a cylindrical coiler can containing sliver deposited in an annular pattern.

FIG. 6 is a top plan view of a flat coiler can containing sliver deposited in an annular pattern.

DESCRIPTION OF THE PREFERRED EMBODIMENTS

Figure 1:
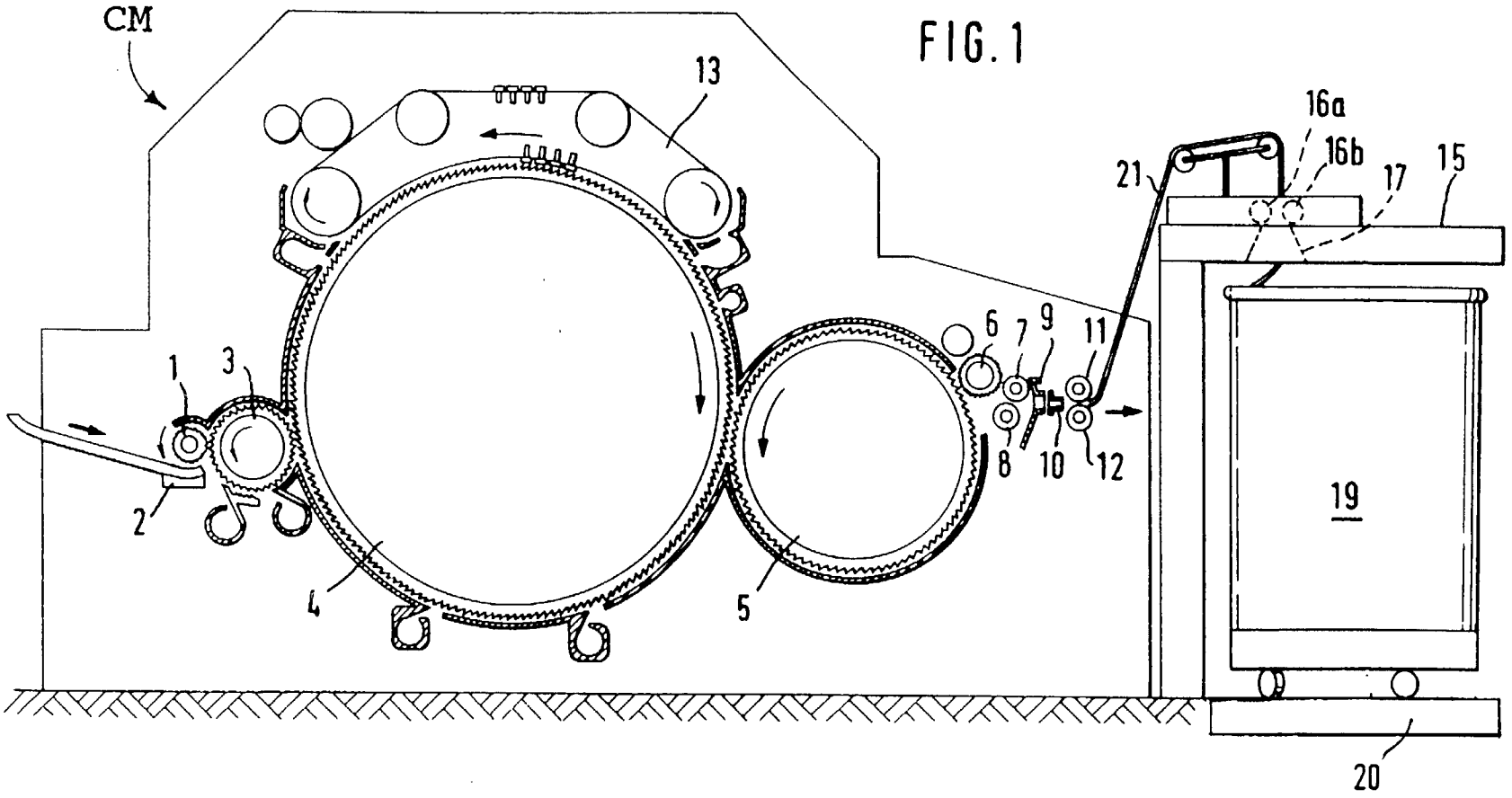
FIG. 1 is a schematic side elevational view of a carding machine incorporating the invention.
Figure 3:
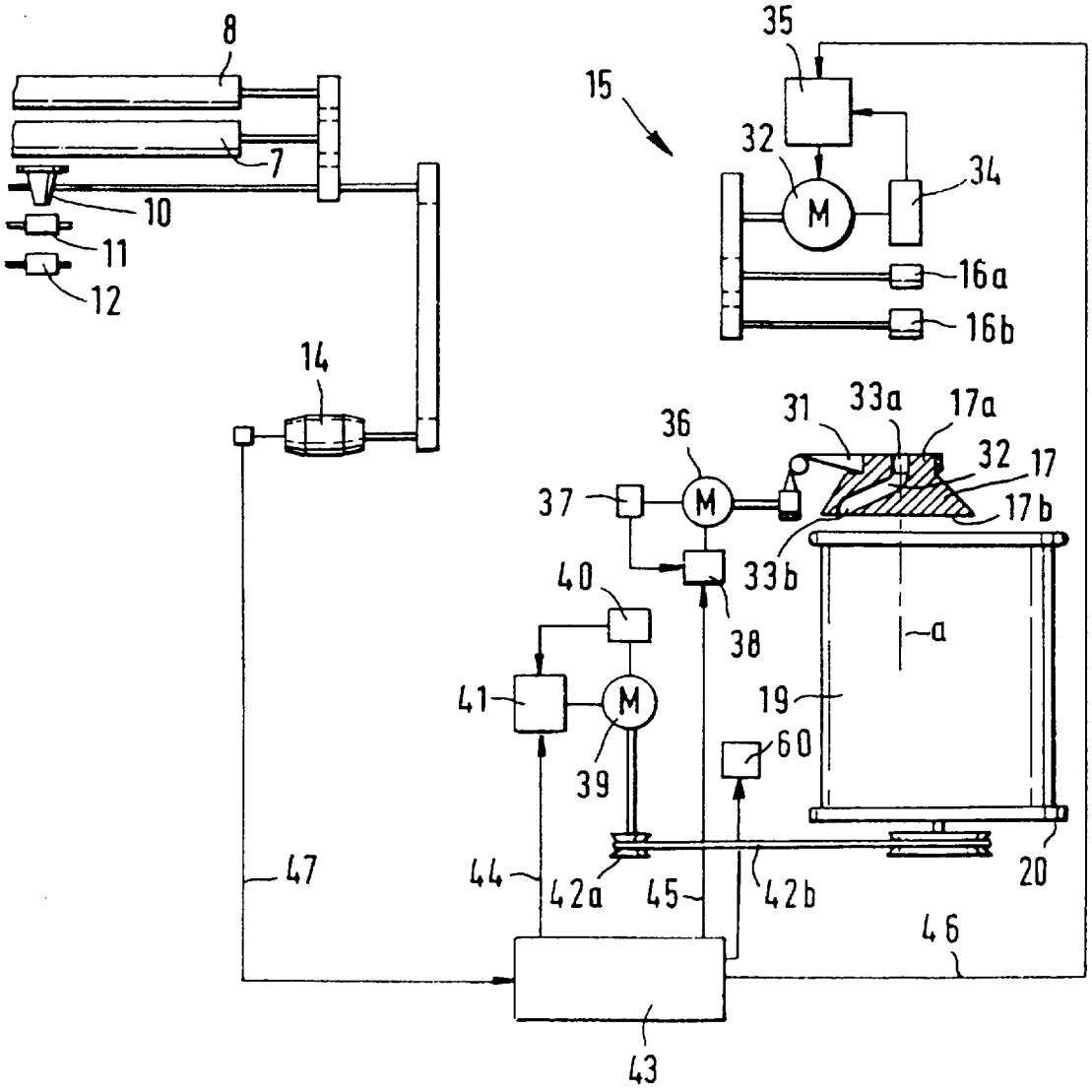
FIG. 3 is a block diagram of a preferred embodiment of the invention associated with a carding machine.

FIG. 1 shows a carding machine CM which may be an EXACTACARD DK 760 model, manufactured by Tr ützschler GmbH & Co. KG, Mönchengladbach, Germany. The carding machine has a feed roll 1, a feed table 2, a licker-in 3, a main carding cylinder 4, a doffer 5, a stripping roll 6, crushing rolls 7 and 8, a web guiding element 9, a sliver trumpet 10, delivery rolls (calender rolls) 11 and 12 as well as traveling flats 13. The delivery rolls 11 and 12, the crushing rolls 7 and 8, the stripping roll 6 and the doffer 5 are driven by a motor 14, as shown in FIG. 3. At the output side of the carding machine CM a sliver coiler 15 is arranged which includes two driven pressure rolls 16*a*, 16*b* and a driven coiler head 17. The cylindrical coiler can 19 is positioned on a driven coiler can platform 20.

Figure 2:
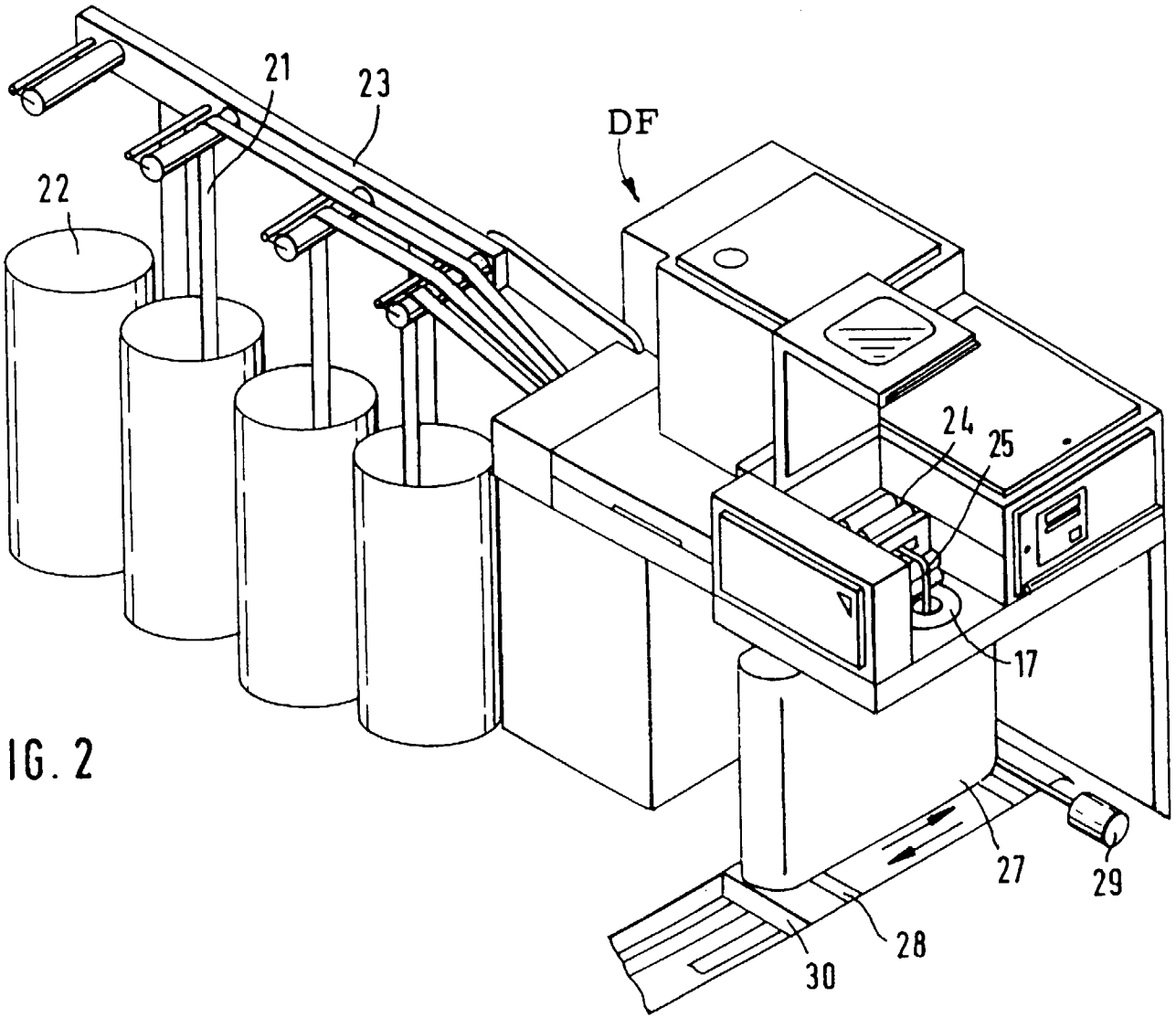
FIG. 2 is a schematic perspective view of a drawing frame incorporating the invention.

FIG. 2 illustrates a drawing frame DF which may be an HS 900 model high-performance drawing frame manufactured by Trützschler GmbH & Co. KG. Underneath the sliver input 23 of the drawing frame DF a plurality of cylindrical (round) coiler cans 22 are arranged and the sliver 21 is drawn from the cans 22 and advanced to the drawing unit 24 of the drawing frame DF. After passing through the drawing unit 24, the drafted sliver 25 is introduced into the coiler head 17 and is deposited thereby in an annular pattern into a flat coiler can 27. The flat coiler can 27 is positioned on a sled 28 which is reciprocated in the direction of the arrows by a shifting device 30 driven by a motor 29.

Turning to FIG. 3, the sliver 21 is advanced to the cooperating pressure rolls (calender rolls) 16*a*, 16*b*. The sliver originates from a sliver-producing spinning preparation machine such as a carding machine CM (FIG. 1) or a drawing frame DF (FIG. 2).

The coiler head 17 is supported for rotation about a vertical axis a and has a belt pulley 17*a* about which a drive belt 31 is trained to provide a driving torque. The coiler head 17 further has a lower plate 17*b* positioned above the coiler can 19 which, in turn, stands on the rotary platform 20. The coiler head 17 has an obliquely oriented sliver channel 33 having an inlet opening 33*a* oriented towards the pressure rolls 16*a*, 16*b* and an outlet opening 33*b* which is situated in the rotary plate 17*b* eccentrically to the vertical axis a of the coiler head 17. The coiler can 19 which may be conventionally provided with a vertically displaceable bottom pressed upwardly by a coil spring, stands on the can platform 20 which is rotatable about a vertical axis coinciding with the axis of the coiler can 19 standing thereon.

The pressure rolls 16*a*, 16*b* are driven by an electric motor 32 which has an rpm transmitter (tachometer) 34 connected to the electric motor 32 by an rpm control device 35. A further electric motor 36 drives the belt 31 to rotate the coiler head 17. The electric motor 36 too, is provided with an rpm transmitter (tachometer) 37 connected to the electric motor 36 by an rpm control device 38. An electric motor 39 drives the coiler can platform 20 by means of a drive pulley 42*a* and a drive belt 42*b*. The electric motor 39 has an rpm transmitter (tachometer) 40 coupled to the electric motor 39 by an rpm control device 41. According to this arrangement all three driving devices have their own rpm-regulating circuit respectively formed of the electric motor 32, 36 and 39, the rpm transmitter 34, 37, and 40 as well as the rpm control device 35, 38 and 41.

The desired rpm values 44, 45, and 46 for the drive motors 39, 36 and 32, respectively, are calculated by a central control and regulating device 43 such as a microcomputer. The desired values 44, 45, and 46 are in a predetermined, variable relationship to the delivery speed value 47 of the sliver-producing machine. A conventional sliver severing device 60 is also connected to the control and regulating device to cut the sliver, for example, downstream of the sliver outlet 33*b* of the coiler head 17 when the desired fill level in the coiler can is reached.

When flat coiler cans 27 are used as shown in FIG. 2, they are linearly reciprocated underneath the coiler head 17 by the back-and-forth travelling sled 28.

In FIG. 4 an rpm transmitter 48 and an rpm control device 49 are associated with the drive motor 29 for the reciprocating device 30 of the sled 28 and are connected to the control and regulating device 43. In other respects, the sliver coiler at the outlet end of the drawing frame DF corresponds to the sliver coiler at the output end of the carding machine CM. It should be understood that at the output end of the drawing frame DF the sliver 25 may be deposited in a rotating cylindrical coiler can in which case the can is supported on a rotary platform 20 as shown in FIGS. 1 and 3.

FIGS. 5 and 6 show the annular pattern of the deposited sliver in a cylindrical coiler can 19 (FIG. 5) and in a flat coiler can 27 (FIG. 6).

If, according to FIGS. 3 and 4, the desired rpm value reaches zero at least for the motor 36 of the coiler head 17, the rotary motion of the coiler head 17 is stopped, whereas the machine continues to produce sliver.

Figure 7:
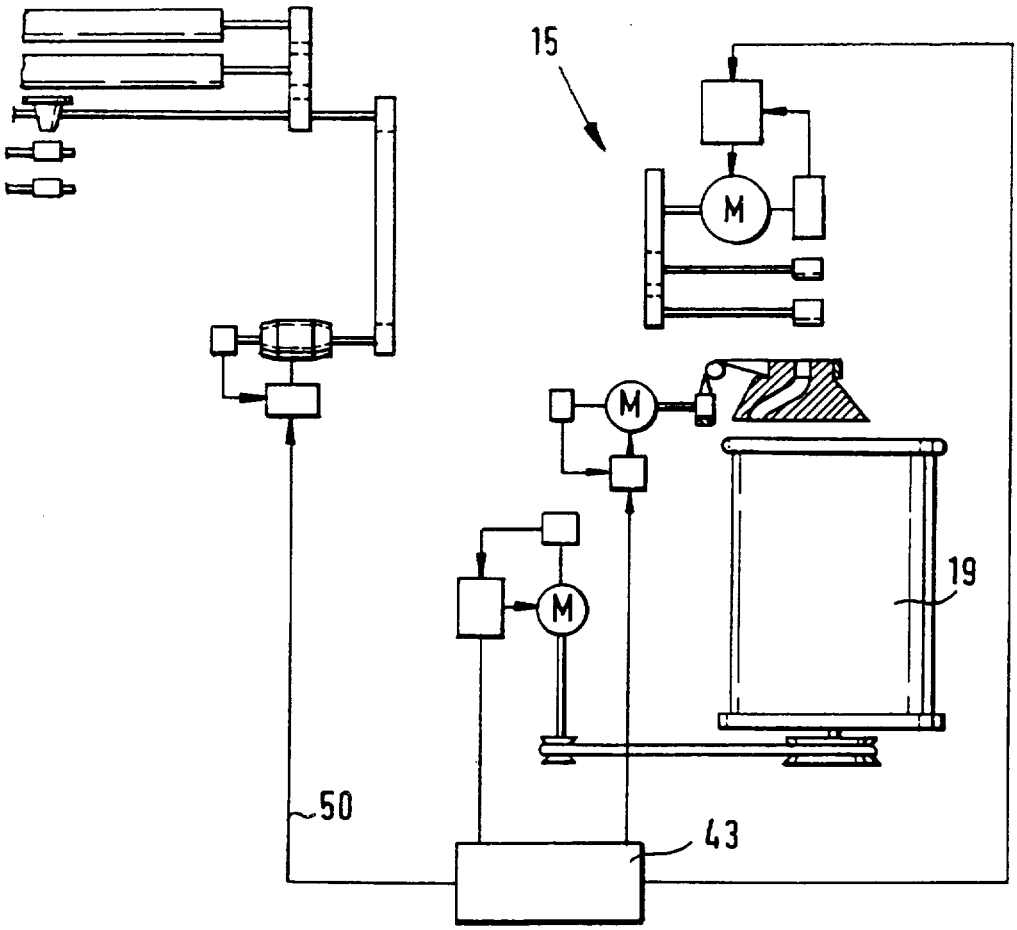
FIG. 7 is a block diagram similar to FIG. 4 showing the application of a desired value for the delivery speed of the sliver-producing machine.

Turning to FIG. 7, the desired values 50 determining the delivery speed of the sliver-producing machine are outputted by the same control and regulating device 43 which controls the sliver coiler assembly 15.

Figure 8:
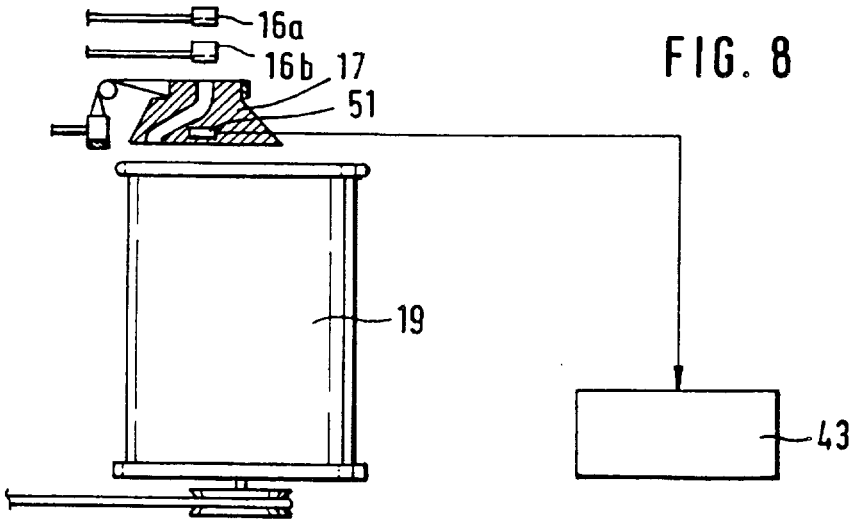
FIG. 8 is a schematic side elevational view of a sliver coiler including a position sensor associated with the coiler head.

In FIG. 8, the coiler head 17 is provided with a sensor 51 such as an incremental path sensor which is connected with the control and regulating device 43 and which enables the device 43 to recognize any location of the coiler sliver outlet 33*b* of the coiler head 17 on its circular path.

Figure 9:
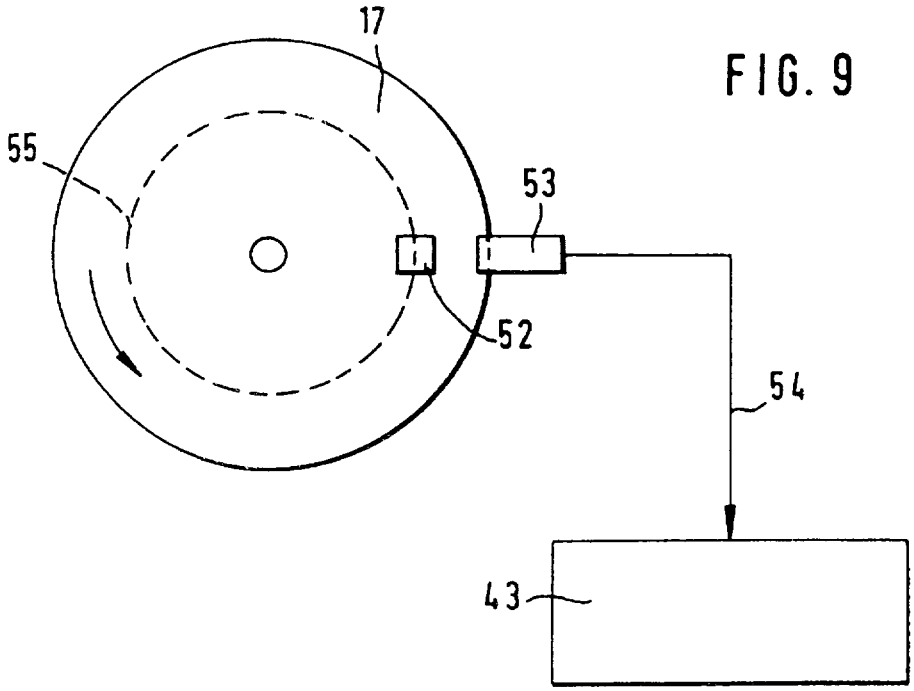
FIG. 9 is a schematic top plan view of a coiler head and a device to determine the angular position thereof.

In FIG. 9 an actuating element 52 and a sensor 53 are shown which cooperate to transmit a signal 54 to the control and regulating device 43 when the sliver outlet 33*b* of the coiler head 17 has reached a predetermined position on its circular travel path. The actuating element 52 is situated on the coiler head 17 or on an element which drives the coiler head and is settable in its position so that it is feasible to activate the sensor for any predetermined position of the sliver outlet 33*b* on the circular path 55.

Figure 10:
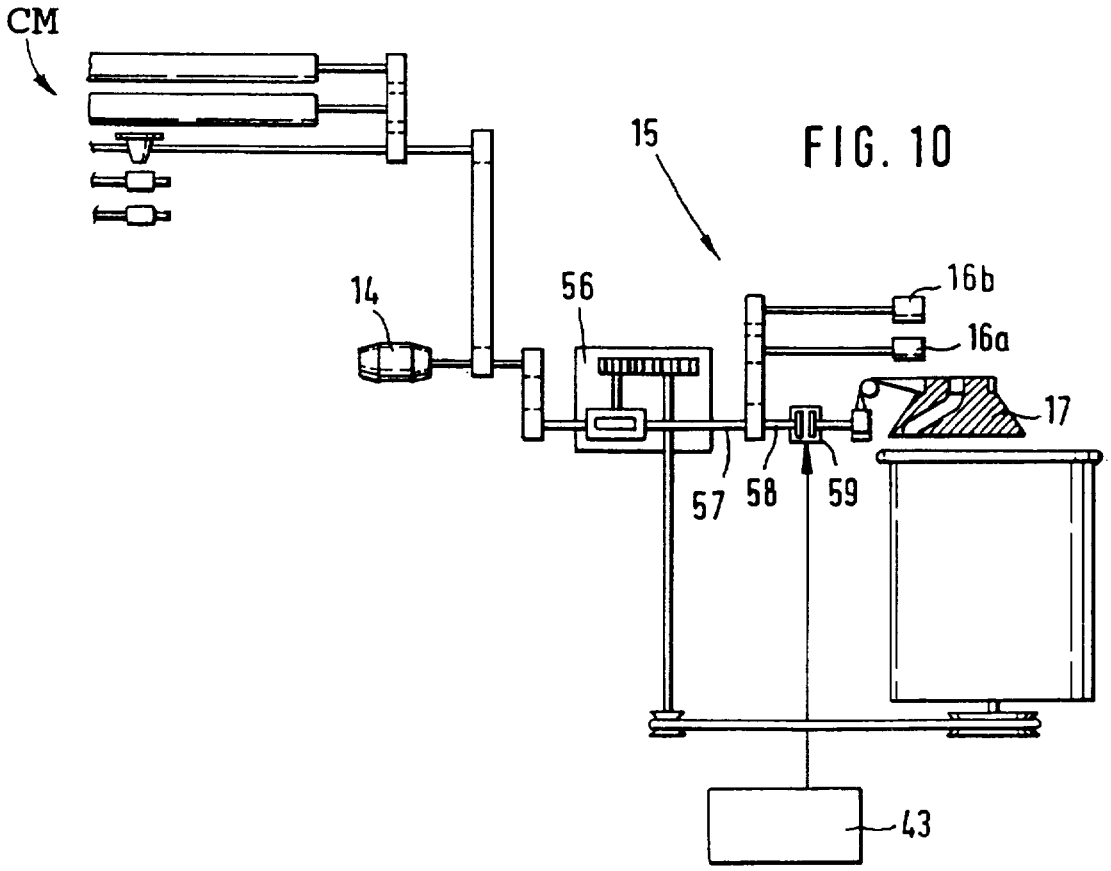
FIG. 10 is a schematic side elevational view, with block diagram, including an electromagnetic clutch associated with the coiler head.

In FIG. 10, the drive motor 14 of the carding machine CM drives the sliver coiler assembly 15 by a gearing 56. An output shaft 57 drives the pressure rolls 16*a*, 16*b* and the coiler head 17. With the drive shaft 58 for the coiler head 17 a remote control clutch 59 such as an electromagnetic clutch is connected for disconnecting the coiler head 17 from its drive. The coiler head 17 is stopped upon actuation of the clutch 59 by the central control and regulating device 43.

It will be understood that the above description of the present invention is susceptible to various modifications, changes and adaptations, and the same are intended to be comprehended within the meaning and range of equivalents of the appended claims.

What is claimed is:

1. A method of depositing sliver into a coiler can, comprising the following steps:

(a) rotating a pair of cooperating pressure rolls;

(b) advancing the sliver by the pressure rolls to a coiler head having a sliver outlet;

(c) rotating said coiler head for causing said sliver outlet to travel in a circular path;

(d) positioning an upwardly open coiler can underneath the coiler head;

(e) moving said coiler can for continuously changing the position thereof relative to said coiler head;

(f) depositing sliver through said sliver outlet of said coiler head into said coiler can during performance of steps (b), (c) and (e), whereby the coiler can is charged with sliver in an annular pattern;

(g) discontinuing step (c) while continuing steps (b) and (e) when said sliver outlet is in a predetermined position on the circular path, whereby the coiler head is stopped from rotating while sliver advance through said sliver outlet and movement of said coiler can continue after a predetermined fill level of the coiler can is reached; and (h) severing the sliver at a time when the coiler head is no longer rotated.

2. An apparatus for depositing sliver in a coiler can, comprising (a) a pair of cooperating pressure rolls;

(b) a coiler head supported for rotation about a rotary axis; said coiler head having a sliver outlet situated eccentrically with respect to said rotary axis, whereby said sliver outlet travels on a circular path upon rotation of the coiler head;

(c) a movable coiler can support disposed underneath said coiler head for receiving an upwardly open coiler can thereon;

(d) drive means for rotating said pressure rolls, for rotating said coiler head about said rotary axis and for moving said coiler can support relative to said coiler head for advancing the sliver through said pressure rolls into said coiler head and for depositing the sliver by said coiler head in an annular pattern into said coiler can;

(e) a control and regulating device; said driving means being electrically connected to said control and regulating device; said control and regulating device including means for stopping rotation of said coiler head at a predetermined location of said sliver outlet on said circular path while said pressure rolls continue to rotate and said coiler can support continues to move; and (f) means for severing said sliver to produce an outer sliver end of the sliver deposited in the coiler can.

3. The apparatus as defined in claim 2, wherein said drive means includes a driving device driving solely said coiler head.

4. The apparatus as defined in claim 2, wherein said drive means includes a driving device driving solely said coiler can support.

5. The apparatus as defined in claim 2, wherein said drive means comprises first, second and third drive circuits connected to said pressure rolls, said coiler head and said coiler can support, respectively; each said drive circuit including a motor, an rpm control device and a motor rpm indicating device.

6. The apparatus as defined in claim 2, wherein said control and regulating device includes means for computing desired values for said drive means.

7. The apparatus as defined in claim 2, further comprising a path sensor connected with said coiler head for generating signals representing momentary positions of said sliver outlet on said circular path, said path sensor being connected with said control and regulating device.

8. The apparatus as defined in claim 7, wherein said sensor is an absolute value transmitter.

9. The apparatus as defined in claim 7, wherein said sensor is an incremental value transmitter.

10. The apparatus as defined in claim 7, wherein said sensor includes an inductive proximity switch and damping elements mounted on said coiler head.

11. The apparatus as defined in claim 7, wherein said sensor includes an optical scanning system.

12. The apparatus as defined in claim 7, wherein said sensor includes an actuating element mounted on said coiler head for rotation therewith and a detector generating a signal representing a position of said actuating element during rotation of said coiler head; said position of said actuating element representing a predetermined position of said sliver outlet on said circular path; said detector being connected with said control and regulating device for applying said signal thereto.

13. The apparatus as defined in claim 12, wherein said actuating element is adjustable for varying said position.

14. The apparatus as defined in claim 2, further comprising clutch means for disconnecting said coiler head from said drive means.

15. The apparatus as defined in claim 14, wherein said clutch means is connected to and actuated by said control and regulating device.

16. The apparatus as defined in claim 14, wherein said clutch means comprises an electromagnetic clutch.

17. The apparatus as defined in claim 2, wherein said control and regulating device includes means for generating desired speed values for said drive means.

18. The apparatus as defined in claim 17, further comprising means for maintaining said desired speed values at a fixed ratio to one another.

19. The apparatus as defined in claim 2, further comprising means for setting the desired speed values at a predetermined, variable ratio to the delivery speed of a sliver-producing machine whose outputted sliver is advanced from the sliver-producing machine to the pressure roll pair.

20. The apparatus as defined in claim 19, wherein said control and regulating device includes said means for generating desired speed values for the sliver-producing machine.

* * * * *